US005080755A

United States Patent [19]

Backlund

[11] Patent Number: 5,080,755

[45] Date of Patent: Jan. 14, 1992

[54] PROCESS FOR THE CONTINUOUS DIGESTION OF CELLULOSIC FIBER MATERIAL

[75] Inventor: Ake Backlund, Karlstad, Sweden

[73] Assignee: Kamyr AB, Karlstad, Sweden

[21] Appl. No.: 420,322

[22] Filed: Oct. 12, 1989

[30] Foreign Application Priority Data

Dec. 20, 1988 [SE] Sweden ..... 8804578

[51] Int. Cl.[5] ..... D21C 3/26; D21C 7/12

[52] U.S. Cl. ..... 162/19; 162/39; 162/41; 162/59; 162/62; 162/239; 162/242; 162/249; 162/251

[58] Field of Search ..... 162/19, 29, 37, 39, 162/59, 237, 239, 242, 248, 249, 251, 41, 62

[56] References Cited

U.S. PATENT DOCUMENTS

| | | | |
|---|---|---|---|
| 2,359,543 | 10/1944 | Branzell et al. | 162/241 |
| 3,035,963 | 5/1962 | Schnyder | 162/19 |
| 3,097,987 | 7/1963 | Sloman | 162/19 |
| 3,425,898 | 2/1969 | Laakso | 162/59 |
| 3,427,218 | 2/1969 | Richter | 162/19 |
| 3,532,594 | 10/1970 | Richter | 162/19 |
| 3,652,384 | 3/1972 | Sloman | 162/19 |
| 3,723,242 | 3/1973 | Barker | 162/42 |
| 3,802,956 | 4/1974 | Backlund | 162/19 |
| 4,071,399 | 1/1978 | Prough | 162/19 |
| 4,608,121 | 8/1986 | Östman | 162/19 |

*Primary Examiner*—Richard V. Fisher
*Assistant Examiner*—Todd J. Burns
*Attorney, Agent, or Firm*—Cushman, Darby & Cushman

[57] ABSTRACT

A process for the continuous digestion of cellulosic fiber material is described wherein the material is impregnated with liquid in a closed system comprising a concurrent flow zone and a countercurrent flow zone, the liquid in the concurrent flow zone including black liquor and possibly white liquor and the liquid in the countercurrent flow zone including white liquor. Liquid is withdrawn from the impregnation system at a point located between the concurrent flow zone and the countercurrent flow zone. Besides white liquor a predetermined amount of black liquor is added to the countercurrent flow zone in order to obtain a high liquid to wood ratio in the inlet of the digester.

4 Claims, 1 Drawing Sheet

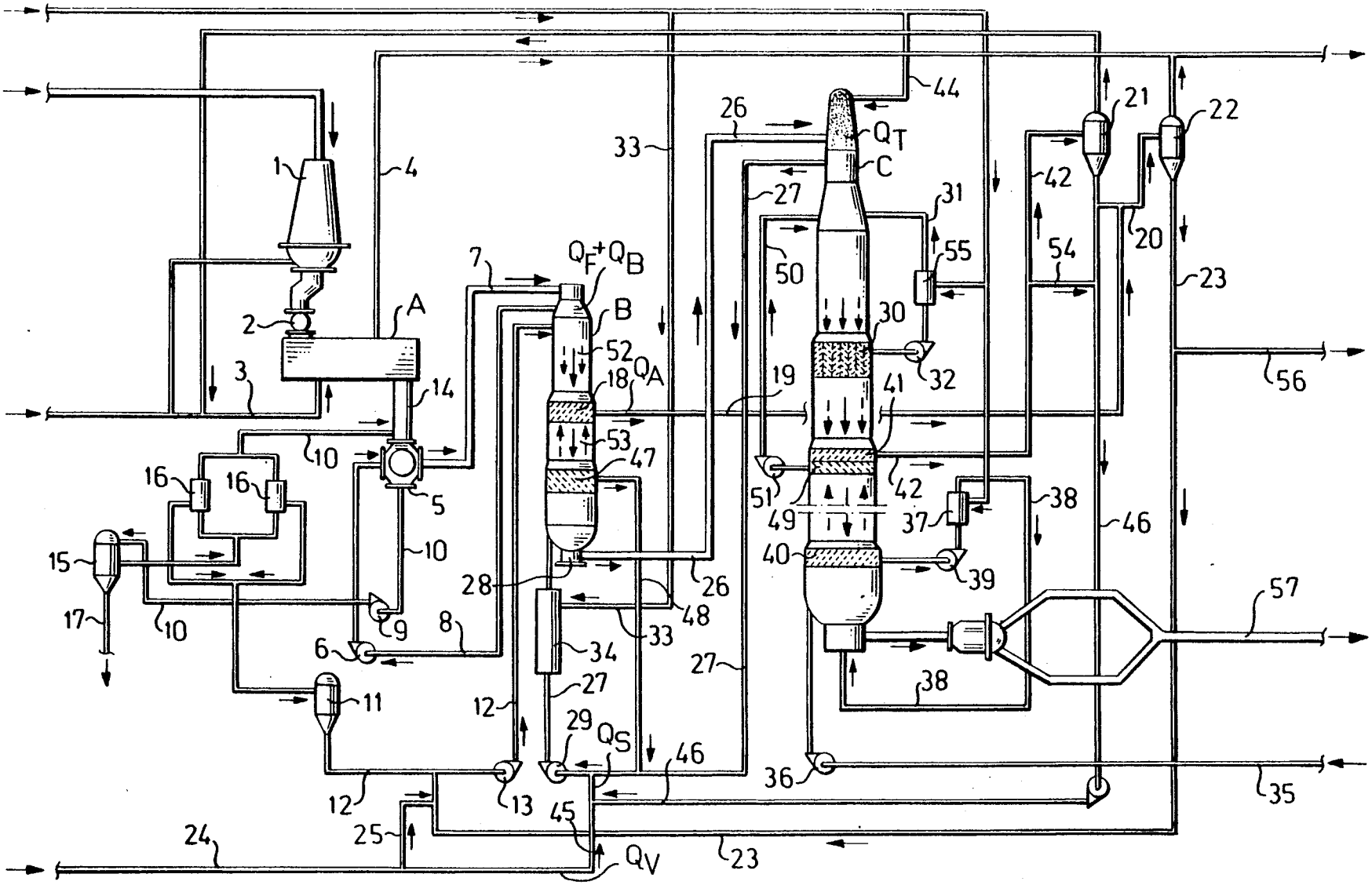
$Q_T$
C
$Q_F+Q_B$
B
$Q_A$
$Q_S$
$Q_V$
A

PROCESS FOR THE CONTINUOUS DIGESTION OF CELLULOSIC FIBER MATERIAL

FIELD AND BACKGROUND OF THE INVENTION

The present invention relates to a process for the continuous digestion of cellulosic fiber material.

Through U.S. Pat. No. 3,802,956 it is known that wood can be impregnated with white liquor in countercurrent flow and that black liquor can be added to the wood material at the inlet to the impregnation vessel. The object of this procedure is primarily to increase the concentration of active chemicals in the digesting liquor by withdrawing a certain amount of impregnation liquid in which the content of active chemicals has been substantially consumed. The liquid to wood ratio in the digester is thereby lowered, thus giving a high concentration of active chemicals which results in rapid digestion. The smaller amount of liquid in the digester in comparison with conventional methods also results in less steam consumption, particularly high-pressure steam. However, it has been found that a low liquid to wood ratio may entail problems in controlling the cooking process, as well as difficulties with the movement of the chip column due to differences in relative speed between chips and free liquid. The relatively high concentration of chemicals in alkaline digestion processes also causes attack on the carbohydrates in the raw wood, resulting in lowered pulp viscosity and pulp strength.

SUMMARY OF THE INVENTION

The object of the present invention is to provide an improved process for the continuous digestion of cellulosic fiber material which eliminates the above-mentioned drawbacks of low liquid to wood ratio in the digester and relatively high alkali concentration at the beginning of the digestion.

The invention relates to a process for the continuous digestion of cellulosic fiber material comprising the steps of impregnating the fiber material with liquid in a closed system comprising a concurrent flow zone and a countercurrent flow zone, withdrawing a predetermined amount of liquid from said impregnation system at a point located between the concurrent flow zone and the countercurrent flow zone, and supplying to the concurrent flow zone black liquor and possibly white liquor and to the countercurrent flow zone white liquor and a predetermined amount of black liquor. According to a preferred embodiment of the invention, the black liquor is added to the countercurrent flow zone in such an amount that a predetermined high liquid to wood ratio is obtained in the inlet of the digester. This liquid to wood ratio is suitably 2.0 to 1 to 4.5 to 1, preferably 3.0 to 1 to 3.5 to 1.

BRIEF DESCRIPTION OF THE DRAWING

The invention will be described further in the following with reference to the drawing showing schematically a flow diagram of a plant for continuous digestion of fiber material impregnated in accordance with the present invention.

DESCRIPTION OF ILLUSTRATED EMBODIMENT

The plant shown in the Figure comprises a horizontal steaming vessel A, a vertical impregnation vessel B and a vertical digester C. The disintegrated fiber material, preferably consisting of wood chips, is fed from a chip bin 1 through a low-pressure valve 2 to the steaming vessel A. Low-pressure steam, having a pressure of e.g. 1 atmosphere over pressure, is supplied to the steaming vessel A through a pipe 3 and air expelled is removed through a pipe 4. After passing through the steaming vessel A for 2 to 5 minutes, the chips fall down into a high-pressure valve 5 comprising a rotor with pockets or diametrical channels, pivotable in a housing. From there the chips are pumped up to the top of the impregnation vessel B by means of a circulating liquid which is caused by a pump 6 to flow through a supply pipe 7 and a return pipe 8. The liquid flushes the chips from the high-pressure valve 5 and feeds the chips in suspension through the supply pipe 7 to the top of the impregnation vessel where a strainer (not shown}is disposed to separate a certain portion of the liquid for recirculation. The liquid strained off is returned through the return pipe 8 to the high-pressure valve 5. The supply pipe 7 and return pipe 8 thus form a circulation system for feeding liquid-carried chips.

The chips are fed into the pockets of the high-pressure valve 5 by means of liquid circulated in a pipe 10 by a pump 9. Liquid which is returned to the low-pressure side flows from this pipe 10 to a level tank 11 connected to the top of the impregnation vessel B via a pipe 12 to feed back the liquid to the high-pressure side by means of a pump 13 disposed in the pipe 12. The circulation pipe 10 is connected to a chip feeder 14 before the high-pressure valve 5 via a sand separator 15 and a pair of screens 16 for screening off excess liquid. Sand and similar undesired particles are removed from the sand separator 15 through a pipe 17.

The impregnation vessel B consists of a vertical, elongate container with circular cross section, suitably becoming wider towards the bottom. The impregnation vessel constitutes or forms a part of a closed impregnation system which, in the embodiment shown, consists of a concurrent flow zone 52 and a countercurrent flow zone 53. At the bottom of the impregnation vessel is a device (not shown) for continuously feeding out chips which have been impregnated with supplied liquids as they move continuously downwards. The impregnation vessel B is provided with a strainer 18 disposed in the wall of the vessel for the removal of a predetermined amount of liquid $Q_A$ from the chip suspension. The liquid withdrawn through the strainer 18 is passed through a pipe 19 to the second one of two flash cyclones 21, 22 connected in series and joined to each other by a pipe 20.

A specified amount of black liquor is pumped through pipe 12 to the top of the impregnation vessel B, the black liquor being supplied through a pipe 23 from the second flash cyclone 22. If desired a small amount of white liquor may be added at the top of the impregnation vessel through a pipe 24, branch pipe 25 and pipe 12.

The impregnated chips are transferred from the bottom of the impregnation vessel B to the top of the digester C by liquid, i.e. digesting liquor, through a supply pipe 26 connected to an outlet 28 at the bottom of the impregnation vessel. A strainer (not shown) is disposed at the top of the digester to separate a certain portion of the liquid for recirculation. The circulation liquid is returned through a return pipe 27 provided with a pump 29, such a strong liquid flow being maintained by the pump in the pipes 26, 27 that chips are carried with it and flushed out through the outlet 28. The supply pipe 26 and return pipe 27 thus form a transfer circulation system for the suspension of impregnated chips and digesting liquor.

In order to achieve uniform distribution of the alkali flowing in countercurrent flow, and to offer the best possible conditions for reaction between alkali and wood, a strainer 47 is preferably inserted at a place between the strainer 18 and the bottom of the impregnation vessel. An amount of liquid is removed from this strainer 47 and circulated through a pipe 48 and pump 29 to the bottom of the impregnation vessel. The countercurrent flow in the lower portion of the countercurrent flow zone will therefore be greater than the upward flow in the upper portion of the countercurrent flow zone located above the strainer 47.

Most of the heating of digesting liquor and wood material occurs indirectly by the addition of high-pressure steam through a pipe 33 to a heat exchanger 34 in the return pipe 27 through which the circulating digesting liquor flows. This heating causes increased reaction rate between wood and effective alkali in the countercurrent flow zone.

The digester is provided with a strainer 30 for circulation of liquid through a pipe 31 by means of a pump 32, the liquid being heated in a heat exchanger 55. The pipe 31 contains a central pipe disposed at the centre of the digester and having its orifice at the strainer 30. The digested fiber material is washed in countercurrent flow in the lower part of the digester, using a washing liquid supplied through a pipe 35 and pumped by a pump 36 into the lower end of the digester in an amount adjusted in such a manner that the digester is kept filled with liquid. The washing liquid is heated indirectly by steam supplied to a heat exchanger 37 disposed in a pipe 38 for circulation of washing liquid by a pump 39. The washing liquid is withdrawn through a strainer 40 and returned through a central pipe extending from the bottom of the digester to the strainer 40. The washing liquid heated in this way is forced upwardly in countercurrent flow through the chips column which is slowly moving downwards, and thereby displaces its content of spent digesting liquor. This can then be withdrawn through a strainer 41 and passed via a pipe 42 to the first one of the two flash cyclones 21, 22. Below the strainer 41 is another strainer 49 for circulation of liquid through a pipe 50 by a pump 51 disposed therein, the liquid being circulated via a central pipe having its orifice at the strainer 49. Effluent from the second flash cyclone 22, which is not supplied to the impregnation vessel, is passed through a pipe 56 to a recovery plant. The digested fiber material is discharged at the bottom of the digester by a suitable scraping device and is passed through a pipe 57 for continued treatment.

Besides the digesting liquor and wood being indirectly heated in said transfer circulation system 26, 27, they are also directly heated by steam supplied to the top of the digester through a pipe 44.

The strainer 18 in the impregnation vessel B is so located that sufficient retention time is obtained for concurrent flow impregnation with black liquor and possibly a small amount of white liquor. The distance to the bottom of the vessel is such that sufficient retention time is obtained for countercurrent flow impregnation with white liquor. For instance, suitable retention times may be 10–20 minutes for concurrent flow impregnation with black liquor and 10–20 minutes for countercurrent flow impregnation with white liquor.

The total amount of liquid to the top of the impregnation vessel B, including chips moisture, steam condensate, black liquor and any white liquor, shall be sufficient to completely saturate the chips with liquid and also to give a certain excess of non-bound liquid in the chips. The bound liquid $Q_B$ in the chips is for pine 1.8 and for birch 1.3 $m^3$/ton dry wood. The amount of free liquid $Q_F$ supplied to the top of the impregnation vessel should not be less than 0.5$m^3$/ton dry wood. In order to improve the flow conditions for the chips, the amount of free liquid $Q_F$ may advantageously be increased to 1.0 $m^3$/ton dry wood, and under certain conditions, up to 2.5 $m^3$/ton dry wood or higher. (The expression "dry" refers to bone dry in the present specification).

An amount of liquid $Q_A$, which would be greater than the amount of free liquid $Q_F$ in the upper part of the impregnation vessel, is withdrawn from the strainer 18. The difference would be so great that an upward flow from the bottom of the impregnation vessel encounters the descending chips and that effective alkali in the white liquor being drawn upwards is consumed through reaction with the wood material. The upward flow should be limited so that the content of effective alkali remaining in the liquid $Q_A$ withdrawn is approximately equivalent to the content of alkali remaining in the liquor withdrawn from the digester for the chemical recovery via the strainer 41, pipes 42, 20, 23 and a pipe 54.

An amount of white liquor required for carrying out the digestion is supplied to the bottom of the impregnation vessel B through a pipe 45 which connects the pipe 24 with the return pipe 27. With a normal white liquor concentration, this amount will be 0.8–1.6$m^3$ /ton dry wood, depending on how great a portion of the white liquor that is supplied to the wood at the top of the impregnation vessel through pipes 25 and 12, the concentration of effective alkali in the white liquor, and the amount of alkali consumed by the wood. According to the present invention a specific amount of black liquor is supplied together with the white liquor, said black liquor being supplied from the flash cyclone 21 through a pipe 46. The amount of black liquor is adjusted so that the desired liquid to wood ratio is obtained in the concurrent flow zone of the digester. This ratio is normally 2.0 to 1 to 4.5 to 1, but in certain cases the liquid amount may be less than 2.0 ton/ton dry wood or higher than 4.5 ton/ton dry wood.

Liquid to wood ratio means the total amount of liquid consisting of wood moisture + steam condensate + white liquor + black liquor per ton dry wood.

The temperature in the top of the impregnation vessel is generally about 110–120° C. and in its bottom, i.e. in the transfer circulation system 26, 27, about 130–160° C. The liquor withdrawn through the strainer 18 has a temperature of about 120–135° C. while the black liquor withdrawn from the digester through the strainer 41 has a temperature of about 150–170° C. A portion of the thermal content in the two withdrawals or black liquors from the impregnation vessel and the digester is recovered from the two flash cyclones 21, 22 and the black liquor effluent from the first flash cyclone 21 may have a temperature of e.g. 125° C. while the black liquor effluent from the second flash cyclone 22 may have a temperature of e.g. 102° C. Black liquors can thus be returned from the two flash cyclones 21, 22 to the process with a heat content close to the temperatures which would be maintained at the top and bottom, respectively, of the impregnation vessel. This has a great value from the thermal economy point of view. It is naturally possible to supply black liquor to the bottom of the impregnation vessel which consists partially or completely of liquor withdrawn from the digester. Said withdrawn liquor may be added in particular if it is advantageous from the thermal economy point of view. For this purpose a connection 54 is disposed between pipes 42 and 46.

An example is given below of cooking pine in accordance with the invention. Using the designations in the Figure and below, the total amount of liquid $Q_T$ per ton of dry wood is calculated in the concurrent flow zone of the digester according to the following equation:

$$Q_T=(Q_B+Q_F)-Q_A+(Q_S+Q_V)+Q_C$$

The amounts of liquid per ton of dry wood are as follows:

| | |
|---|---|
| Chips moisture | 1.0 $m^3$ |
| Steam condensate to steaming vessel | 0.3 $m^3$ |
| White liquor to top of impregnation vessel | 0.4 $m^3$ |
| Black liquor to top of impregnation vessel | 1.5 $m^3$ |
| Total amount of liquid in concurrect flow zone of impregnation vessel | 3.2 $m^3$ |
| Bound liquid in chips (wood density 0.40 ton/$m^3$) | $Q_B$ = 1.8 $m^3$ |
| Free liquid in concurrent flow zone of impregnation vessel (3.2-$Q_B$) | $Q_F$ = 1.4 $m^3$ |
| Withdrawn liquid from strainer in impregnation vessel | $Q_A$ = 2.0 $m^3$ |
| Upward flow in countercurrent flow zone of impregnation vessel | $Q_A$-$Q_F$ = 0.6 $m^3$ |
| White liquor to bottom of impregnation vessel | $Q_V$ = 1.2 $m^3$ |
| Steam condensate to top of digester | $Q_C$ = 0.2 $m^3$ |

In order to achieve a liquid to wood ratio of 3.2 to 1 in the digester, the amount of black liquid $Q_S$ which must be supplied to the bottom of the impregnation vessel is calculated according to the following equation:

$$Q_S=Q_T-(Q_B+Q_F)+Q_A-Q_V-Q_C$$

$$Q_S=2.3-(1.8+1.4)+2.0-1.2-0.2$$

$$Q_S=0.6\ m^3$$

The balance ratio for effective alkali as NaOH is approximately as follows for the two additions of white liquor:

| | |
|---|---|
| Effective alkali to top of impregnation vessel | 45 kg NaOH/ton dry wood |
| Effective alkali to bottom of impregnation vessel | 135 kg NaOH/ton dry wood |
| Total charge of effective alkali | 180 kg NaOH/ton dry wood |

Consumption of effective alkali in the impregnation vessel B is distributed as follows:

| | |
|---|---|
| In concurrent flow zone 52 | 40 kg NaOH/ton dry wood |
| In countercurrent flow zone 53 | 50 kg NaOH/ton dry wood |
| Total consumption in impregnation vessel | 90 kg NaOH/ton dry wood |

The liquid $Q_A$ withdrawn from the impregnation vessel contains effective alkali in an amount of 15 kg NaOH/ton dry wood. The remaining effective alkali conveyed to the digester will therefore be 180−90−15=75 kg NaOH/ton dry wood, corresponding to a concentration of effective alkali at the beginning of the cooking zone of the digester of 75/3.2=23 g NaOH/l digesting liquor.

The concentration of effective alkali obtained, 23 g/l calculated as NaOH, is sufficiently low not to cause any appreciable breakdown of the carbohydrates of the pulp during the initial stage of the digestion. Should an even lower concentration be desired, this can be provided by passing a flow of liquid from the trimming strainer 30 in the digester to the transfer circulation system. Due to the consumption of effective alkali in the upper portion of the digester, the concentration of effective alkali in the trimming circulation system through the strainer 30 will be lower than in the feed-back of the transfer circulation system. The content of effective alkali in the transfer circulation system is thereby further lowered.

The process according to the invention can also be utilized in two-vessel hydraulic digesters where the liquid in the transfer circulation system is heated to full cooking temperature, i.e. 160–170° C.

In the embodiment shown in the Figure impregnation is combined with concurrent flow cooking in the digester C. It is also highly beneficial in extended digestion where cooking is also performed in two stages comprising a first concurrent flow stage and a second countercurrent flow stage.

The process according to the invention is also applicable in continuous operating digesters where impregnation and cooking are carried out in the same vessel, the impregnation stage being performed in the upper part of the vessel and the cooking stage therebelow.

That which is claimed is:

1. A process for the continuous digestion of cellulosic fiber material using a closed impregnation system having a concurrent flow zone followed by a countercurrent flow zone, and a digester system, comprising the steps of impregnating the fiber material with liquid in the closed impregnation system, withdrawing a predetermined amount of liquid from the impregnation system at a point located between the concurrent flow zone and the countercurrent flow zone, and supplying to the concurrent flow zone black liquid, and to the countercurrent flow zone white liquor and a predetermined amount of black liquor;

wherein the liquids withdrawn from the impregnation system and the digester system are transferred to at least two serially connected flash cyclones for heat recovery, the black liquor supplied to the countercurrent flow zone of the impregnation system comprising substantially the effluent from the first one of the flash cyclones which receives liquid withdrawn from the digester between a digester concurrent flow zone and a digester countercurrent flow zone, and the black liquor supplied to the concurrent flow zone of the impregnation system consisting of the effluent from a subsequent flash cyclone which receives liquid withdrawn from the digester via said first flash cyclone and liquid withdrawn from the impregnation system.

2. A process as recited in claim 1 wherein the black liquor supplied to the countercurrent flow zone of the impregnation system also comprises liquid withdrawn from the digester which has not passed the first flash cyclone.

3. A process as received in claim 1 comprising the further step of supplying white liquor to the concurrent flow zone.

4. A process as recited in claim 3 wherein the impregnation system includes an impregnation vessel and black liquor and white liquor are added to the fiber material in the concurrent flow zone in an amount such that the quantity of free liquor in the concurrent flow zone of the impregnation vessel is above 0.5 $m^3$/ton dry fiber material.

* * * * *

UNITED STATES PATENT AND TRADEMARK OFFICE

CERTIFICATE OF CORRECTION

PATENT NO. : 5,080,755

DATED : January 14, 1992

INVENTOR(S) : Ake BACKLUND

It is certified that error appears in the above-identified patent and that said Letters Patent is hereby corrected as shown below:

Column 2, line 17, delete "}" and insert therefor --)--.

Column 5, line 44, change "$Q_S$=2.3-(1.8+1.4)+2.0-1.2-0.2" to --$Q_S$=3.2-(1.8+1.4)+2.0-1.2-0.2--.

Column 6, line 46, delete "liquid" and insert therefor "liquor".

Signed and Sealed this

Twenty-seventh Day of April, 1993

*Attest:*

MICHAEL K. KIRK

*Attesting Officer*

*Acting Commissioner of Patents and Trademarks*